US009834956B2

(12) United States Patent
Hogan

(10) Patent No.: US 9,834,956 B2
(45) Date of Patent: Dec. 5, 2017

(54) SAFETY MECHANISM FOR DOOR HANDLE

(75) Inventor: Michael P. Hogan, Carmel, IN (US)

(73) Assignee: Schlage Lock Company LLC, Carmel, IN (US)

( * ) Notice: Subject to any disclaimer, the term of this patent is extended or adjusted under 35 U.S.C. 154(b) by 468 days.

(21) Appl. No.: 14/371,924

(22) PCT Filed: Jan. 11, 2012

(86) PCT No.: PCT/US2012/020862
§ 371 (c)(1),
(2), (4) Date: Oct. 13, 2014

(87) PCT Pub. No.: WO2013/105942
PCT Pub. Date: Jul. 18, 2013

(65) Prior Publication Data
US 2015/0048626 A1 Feb. 19, 2015

(51) Int. Cl.
*E05C 1/04* (2006.01)
*E05B 13/10* (2006.01)
(Continued)

(52) U.S. Cl.
CPC ..... *E05B 13/106* (2013.01); *E05B 3/00* (2013.01); *E05B 13/005* (2013.01); *E05B 55/06* (2013.01);
(Continued)

(58) Field of Classification Search
CPC ..... E05B 13/005; E05B 13/10; E05B 13/106; E05B 17/00; E05B 17/20; E05B 17/2042; E05B 55/06; E05B 65/0014
(Continued)

(56) References Cited

U.S. PATENT DOCUMENTS 108,361 A * 10/1870 Kent ..... E05B 63/244 292/150
284,715 A * 9/1883 Bernstein ..... H01H 13/62 200/318.1
(Continued)

FOREIGN PATENT DOCUMENTS

CN 101072521 11/2007
CN 201714147 1/2011
(Continued)

OTHER PUBLICATIONS

English translation of the Notification of First Office Action and Search Report from the State Intellectual Property Office of the People's Republic of China for Application No. 201280071172.7 dated Dec. 30, 2015 (11 pages).
(Continued)

*Primary Examiner* — Carlos Lugo
(74) *Attorney, Agent, or Firm* — Michael Best & Friedrich LLP

(57) ABSTRACT

A mechanism for selectively coupling a first moving part with a second moving part. The mechanism includes and engaging member that is movable between a detent position, a uncoupled position, and a coupled position in which the load transferring surface is within the aperture. A biasing member biases the engaging member into the detent position or coupled position. The engaging member overrides the biasing force and moves out of the detent position into the uncoupled position when first and second moving parts move relative to each other. When the engaging member is in the coupled position, the first and second moving parts are coupled for movement together. One embodiment of the invention is a child safety door handle rotating on a spindle. Other embodiments include water faucets, stove or burner controls, or any other rotatable or movable parts.

13 Claims, 8 Drawing Sheets

(51) Int. Cl.

| | |
|---|---|
| ***E05B 65/00*** | (2006.01) |
| ***E05B 13/00*** | (2006.01) |
| ***E05B 3/00*** | (2006.01) |
| ***E05B 55/06*** | (2006.01) |
| *E05B 1/00* | (2006.01) |
| *E05B 17/00* | (2006.01) |
| *E05B 15/04* | (2006.01) |
| *F24C 15/02* | (2006.01) |

(52) U.S. Cl.
CPC ..... *E05B 65/0014* (2013.01); *E05B 13/10* (2013.01); *E05B 17/00* (2013.01); *E05B 2015/0448* (2013.01); *F24C 15/024* (2013.01); *Y10T 16/458* (2015.01); *Y10T 292/1016* (2015.04)

(58) Field of Classification Search
USPC ..... 292/150, 163, 174, 347, 348; 70/207, 70/209, 210, 211, 215, 218, 221
See application file for complete search history.

(56) References Cited

U.S. PATENT DOCUMENTS

| | | | | | |
|---|---|---|---|---|---|
| 528,269 | A | * | 10/1894 | Bettys | E05B 17/2042 292/150 |
| 903,857 | A | * | 11/1908 | Hileman | E05C 1/16 292/150 |
| 1,379,048 | A | * | 5/1921 | Scholl | E05B 17/2038 292/150 |
| 1,520,509 | A | * | 12/1924 | Rancour | E05B 17/2019 292/150 |
| 1,648,498 | A | * | 11/1927 | Morgan | B26B 13/04 292/150 |
| 1,956,388 | A | * | 4/1934 | Kalina | E05B 13/002 292/150 |
| 2,046,342 | A | * | 7/1936 | Muck | E05B 13/005 292/348 |
| 2,322,892 | A | | 6/1943 | Springer | |
| 2,517,075 | A | | 8/1950 | Aquila | |
| RE23,495 | E | * | 5/1952 | McDaniel et al. | A43D 3/023 12/136 R |
| 2,738,665 | A | | 3/1956 | North et al. | |
| 3,206,238 | A | | 9/1965 | Speight et al. | |
| 4,226,451 | A | | 10/1980 | Gingras | |
| 4,362,035 | A | | 12/1982 | Vitale | |
| 4,699,406 | A | * | 10/1987 | Swanson, Jr. | E05B 65/0864 292/175 |
| 4,876,866 | A | | 10/1989 | Fleming et al. | |
| 5,040,652 | A | | 8/1991 | Fish et al. | |
| 5,052,731 | A | | 10/1991 | Hayakawa et al. | |
| 5,445,423 | A | | 8/1995 | Mader | |
| 5,738,394 | A | | 4/1998 | Arabia, Jr. et al. | |
| 5,762,383 | A | | 6/1998 | Gomi | |
| 5,794,472 | A | | 8/1998 | Kester et al. | |
| 5,901,590 | A | * | 5/1999 | Lai | E05B 13/106 292/DIG. 37 |
| 6,179,352 | B1 | * | 1/2001 | Schneeberger | E05B 13/005 292/336.3 |
| 6,189,351 | B1 | | 2/2001 | Eagan et al. | |
| 6,324,879 | B1 | * | 12/2001 | Kennedy | E05B 13/001 70/416 |
| 6,615,630 | B2 | | 9/2003 | Wu et al. | |
| 6,860,129 | B2 | | 3/2005 | Eller et al. | |
| 7,273,242 | B2 | | 9/2007 | Godin Flott et al. | |
| 7,334,824 | B2 | | 2/2008 | Sundberg et al. | |
| 8,353,188 | B1 | * | 1/2013 | Byerly | E05B 13/005 292/DIG. 37 |
| 2002/0066297 | A1 | | 6/2002 | Wu et al. | |
| 2009/0266121 | A1 | | 10/2009 | Craig | |
| 2009/0282652 | A1 | | 11/2009 | Maramba | |
| 2010/0257906 | A1 | | 10/2010 | Sorensen et al. | |

FOREIGN PATENT DOCUMENTS

| | | | | | |
|---|---|---|---|---|---|
| DE | 2648146 | | * | 4/1978 | |
| DE | 29510867 | U1 | * | 9/1995 | E05B 13/106 |
| DE | 202009011097 | | | 12/2009 | |
| EP | 0241245 | A1 | | 10/1987 | |
| FR | 2589340 | A1 | * | 5/1987 | A47B 67/02 |
| FR | 2671126 | A1 | * | 7/1992 | E05B 13/005 |
| FR | 2672927 | A1 | * | 8/1992 | E05B 13/005 |
| FR | 2730755 | A1 | * | 8/1996 | E05B 13/005 |
| GB | 190518408 | A | | 5/1906 | |
| JP | 09004287 | A | | 1/1997 | |
| WO | 2004067882 | | | 8/2004 | |

OTHER PUBLICATIONS

Supplementary European Search Report from the European Patent Office for Application No. 12865300.3 dated Jul. 1, 2016 (13 pages).

PCT International Search Report and Written Opinion for PCT Application No. PCT/US2012/020862 dated Sep. 12, 2012 (10 pages).

PCT International Preliminary Report on Patentability for PCT Application No. PCT/US2012/020862 dated Apr. 14, 2014 (5 pages).

* cited by examiner

SAFETY MECHANISM FOR DOOR HANDLE

BACKGROUND

The present invention relates to coupling and uncoupling mechanism or "safety mechanism" for a door handle assembly or other assembly that includes a rotatable spindle.

SUMMARY

The invention provides a door latching apparatus comprising: a latching mechanism configured to be mounted on a door, the latching mechanism including a latching member having extended and retracted positions relative to the door for releasably securing the door relative to an adjacent structure, and the latching mechanism including a pivoting member operably connected to the latching member such that pivotal movement of the pivoting member about an axis moves the latching member between the extended and retracted positions, the pivoting member having therein an aperture defined by a wall, a handle manually pivotable about the axis, the handle including a hub surrounding a portion of the pivoting member, the hub having therein an opening, and a safety mechanism including a manually movable cam member having a detent surface and a driving surface, the cam member movable relative to the hub between an inner position, an outer position and an intermediate position between the inner and outer positions, and the mechanism also including a first spring exerting on the cam member a force biasing the cam member in the direction from the intermediate position to the inner position, and a second spring exerting on the cam member a force biasing the cam member in the direction from the inner position to the intermediate position, the first and second springs having spring forces such that the cam member is in the intermediate position absent external forces, wherein, when the cam member is in the intermediate position, the cam member extends partially into the aperture such that if the handle is pivoted relative to the pivoting member, engagement between the detent surface and the wall causes the cam member to move against the force of the spring to the outer position, wherein, when the cam member is in the outer position, the cam member is withdrawn from the aperture such that pivotal movement of the handle does not cause pivotal movement of the pivoting member, and wherein, when the cam member is in the inner position, the cam member extends fully into the aperture such that if the handle is pivoted relative to the pivoting member, the driving surface of the cam member engages the wall and pivotal movement of the handle causes pivotal movement of the pivoting member.

The invention also provides an apparatus comprising: a pivoting member pivotable about an axis and configured to be operably connected to a device to be operated, the pivoting member having therein an aperture defined by a wall, an actuating member manually pivotable about the axis, the actuating member including a hub surrounding a portion of the pivoting member, the hub having therein an opening, and a safety mechanism including a manually movable cam member having a detent surface and a driving surface, the cam member movable relative to the hub between an inner position, an outer position and an intermediate position between the inner and outer positions, and the mechanism also including a first spring exerting on the cam member a force biasing the cam member in the direction from the intermediate position to the inner position, and a second spring exerting on the cam member a force biasing the cam member in the direction from the inner position to the intermediate position, the first and second springs having spring forces such that the cam member is in the intermediate position absent external forces, wherein, when the cam member is in the intermediate position, the cam member extends partially into the aperture such that if the actuating member is pivoted relative to the pivoting member, engagement between the detent surface and the wall causes the cam member to move against the force of the spring to the outer position, wherein, when the cam member is in the outer position, the cam member is withdrawn from the aperture such that pivotal movement of the actuating member does not cause pivotal movement of the pivoting member, and wherein, when the cam member is in the inner position, the cam member extends fully into the aperture such that if the actuating member is pivoted relative to the pivoting member, the driving surface of the cam member engages the wall and pivotal movement of the actuating member causes pivotal movement of the pivoting member.

The invention also provides a mechanism for selectively coupling a first moving part with a second moving part such that the first and second moving parts move together, the second moving part having an aperture, the mechanism comprising: an engaging member carried by the first part, the engaging member having a detent surface and a load transferring surface, the engaging member being movable between a detent position in which the detent surface is within the aperture of the second moving part, a uncoupled position in which the engaging member is fully retracted from the aperture, and a coupled position in which the load transferring surface is within the aperture; a biasing member acting with a biasing force on the engaging member to bias the engaging member into the detent position or into the coupled position; and an actuating member for manually actuating the engaging member to overcome the biasing force of the biasing member and move the engaging member into the coupled position or detent position; wherein relative movement of the first moving part and second moving part with the engaging member in the detent position results in a component of force acting against the biasing force, such that the biasing force is overcome and the engaging member rides out of the aperture in the second moving member, into the uncoupled position.

In some embodiments, the first moving part comprises a handle and the second moving part comprises a spindle on which the handle is supported, the handle and spindle rotating about a concentric axis of rotation. In some embodiments, the handle includes a lever; wherein the lever is in a horizontal condition when the engaging member is in the detent position; and wherein the biasing force is sufficient to maintain the engaging member in the detent position under at-rest torque applied to the lever under the influence of gravity. In some embodiments, the engaging member includes a cam member that defines the detent surface and load transferring surface, and a stem having a first free end extending through a portion of the first moving part and an opposite second end that is attached to the cam member; wherein the stem defines a stem axis; and wherein movement of the engaging member between the detent, coupled, and uncoupled positions is in a direction parallel to the stem axis. In some embodiments, movement of the engaging member from the detent position to the uncoupled position is in an opposite direction from movement of the engaging member from the detent position to the coupled position. In some embodiments, the first moving part and second moving part are rotatable about a common pivot axis; wherein the stem axis is perpendicular to the pivot axis; wherein movement of the engaging member from the detent position to the uncoupled position is radially away from the pivot axis; and wherein movement of the engaging member from the detent position to the coupled position is radially toward the pivot axis. In some embodiments, the engaging member includes a button mounted to the first end of the stem. In some embodiments, the engaging member moves in a first direction from the detent position to the uncoupled position and in a second direction, opposite the first direction, from the detent position to the coupled position; and wherein the biasing member includes first and second springs applying respective opposing first and second biasing forces on the engaging member, a combination of the first and second opposing biasing forces resulting in the biasing force that biases the engaging member toward the detent position; wherein movement of the engaging member toward the coupled position deflects the first spring to increase the first biasing force and relaxes the second spring to decrease the second biasing force; and wherein movement of the engaging member toward the uncoupled position deflects the second spring to increase the second biasing force and relaxes the first spring to decrease the first biasing force. In some embodiments, the invention further comprises a locking mechanism with which the engaging member can be manually moved and locked into the detent position or the coupled position against the biasing force.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
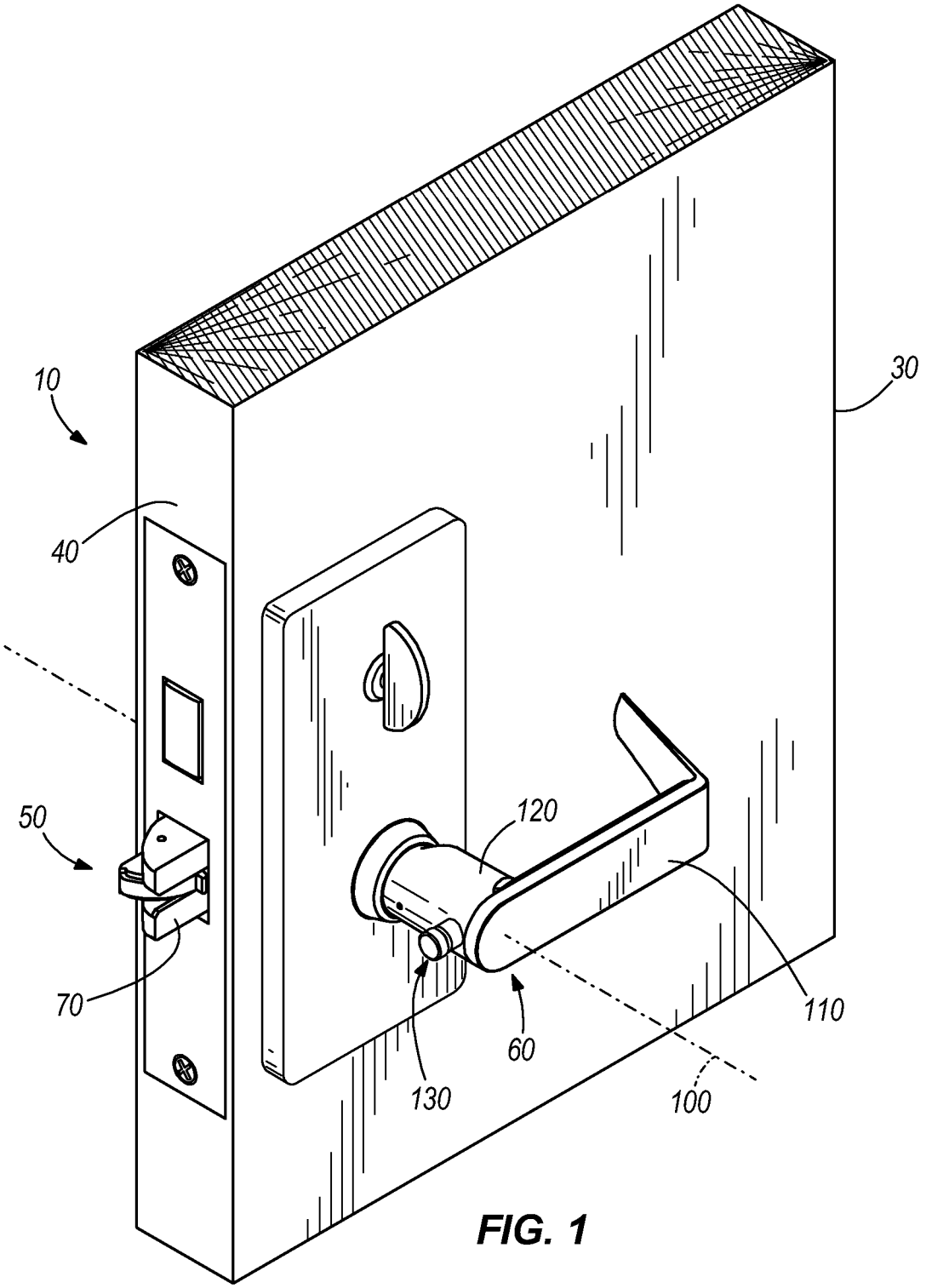
FIG. 1 is a perspective view of a door having a handle that incorporates a safety mechanism according to the present invention.

FIG. 1 illustrates a door 10 including a child safety handle according to the present invention. As will be noted below, the invention can be applied to virtually any mechanism that selectively couples and uncouples a handle with a concentric spindle on which the handle is supported, but for the sake of example, the invention is illustrated in a door handle application. The door 10 includes a hinge edge 30 and a free edge 40. The door 10 pivots within a door jamb between open and closed positions. Mounted to the door 10 are a latching mechanism 50 and a door handle assembly 60.

Figure 2:
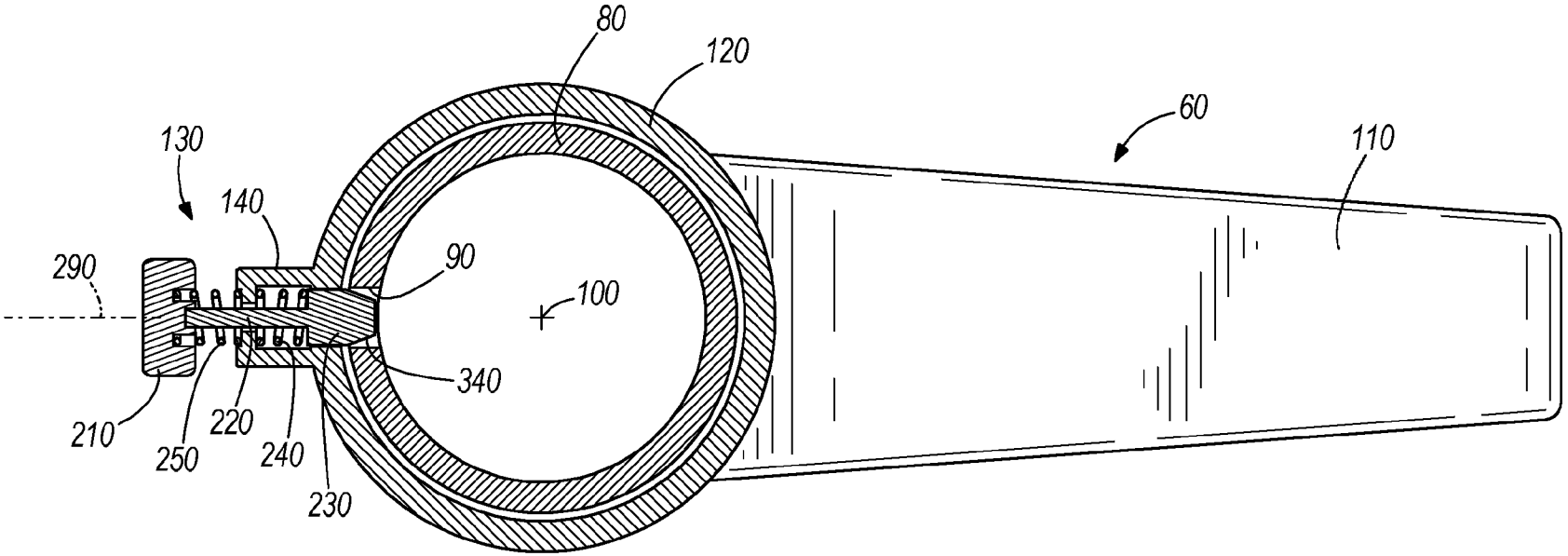
FIG. 2. is a cross-sectional view of the handle and safety mechanism in an intermediate position.

The latching mechanism 50 is configured to be mounted on the door 10, and includes a latching member 70 and a spindle or pivoting member 80 (FIG. 2). The terms "latch," "latching," and variations thereon are intended to cover a mechanism that can temporarily latch the door closed or that can lock the door closed. In this regard, "latch" and its variations should be interpreted as "latch or lock" in this written description and the appended claims. The latching member 70 is movable between an extended position and a retracted position relative to the door 10. In the extended position, a free end of the latching member 70 extends out of the free edge 40 of the door 10. The latching member 70 is biased into the extended position. In the retracted position, the latching member 70 is moved axially against a biasing force into the door 10. In the retracted position, the end of the latching member 70 does not extend significantly, if at all, beyond the free edge 40 of the door 10. When the door 10 is moved into the closed position, the latching member 70 deflects axially into the retracted position in response to the free end impacting the door jamb. The biasing force moves the latching member 70 axially into the extended position when the latching member 70 aligns with a receptacle in the door jamb. When in the extended position and engaged in the receptacle, the latching member 70 retains the door 10 in the closed position, and releasably secures the door 10 relative to an adjacent structure, such as a wall to which the jamb is mounted.

Referring to FIG. 2, the pivoting member 80 of the latching mechanism 50 includes a wall that defines an aperture 90. In the illustrated embodiment, and in known door handle assemblies and mechanisms, the aperture 90 is a keyway. As used in this specification, the term "aperture" is intended to include any slot, hole, recess, bore, blind bore, groove, or the like. Rotation of the pivoting member 80 about an axis 100 moves the latching member 70 between the extended and retracted positions. With the pivoting member 80 pivoted and the latching member 70 in the retracted position, the door 10 can be pushed or pulled into the open position because the latching member 70 is retracted from the receptacle in the doorjamb.

The door handle assembly 60 includes a handle 110, a hub 120, and a safety mechanism 130. The hub 120 surrounds and is supported by the pivoting member 80. The handle 110 and hub 120 are manually pivotable about the pivot axis 100. The safety mechanism 130 is mounted to the hub 120. The handle 110 is illustrated as having a lever shape for illustrative purposes only, and can in other embodiments be provided as a round door knob or a handle of any other shape that is turned to actuate the latching mechanism 50. In this regard, the term "handle" is intended to broadly encompass any manually rotatable element, without regard to its shape.

In known door handle assemblies 60, there is no safety mechanism 130 and the hub 120 includes an inwardly-projecting key that mates with the keyway 90 of the pivoting member 80, such that the hub 120 is always coupled for rotation with the pivoting member 80. Known safety apparatus for door knobs often surround the knob, such that a person grasps the safety apparatus. Such known safety apparatus rotate with respect to the door knob (i.e., transmit no torque to the door knob) unless the person actuates an element that couples the safety apparatus and door knob (e.g., by friction). Such known safety apparatus have at least a few disadvantages compared to the safety mechanism of the present invention: the known safety apparatus are only useful on round door knobs; the known safety apparatus cover the door knob, which creates a different (often undesirable) visual impression of the door knob compared to other door knobs in the building; and such safety apparatus are often not lockable into a coupled condition with the door knob (i.e., the safety apparatus has to be actuated every time to door knob is turned, even when it is desired to leave the safety apparatus and door knob coupled for a period).

Figure 3:
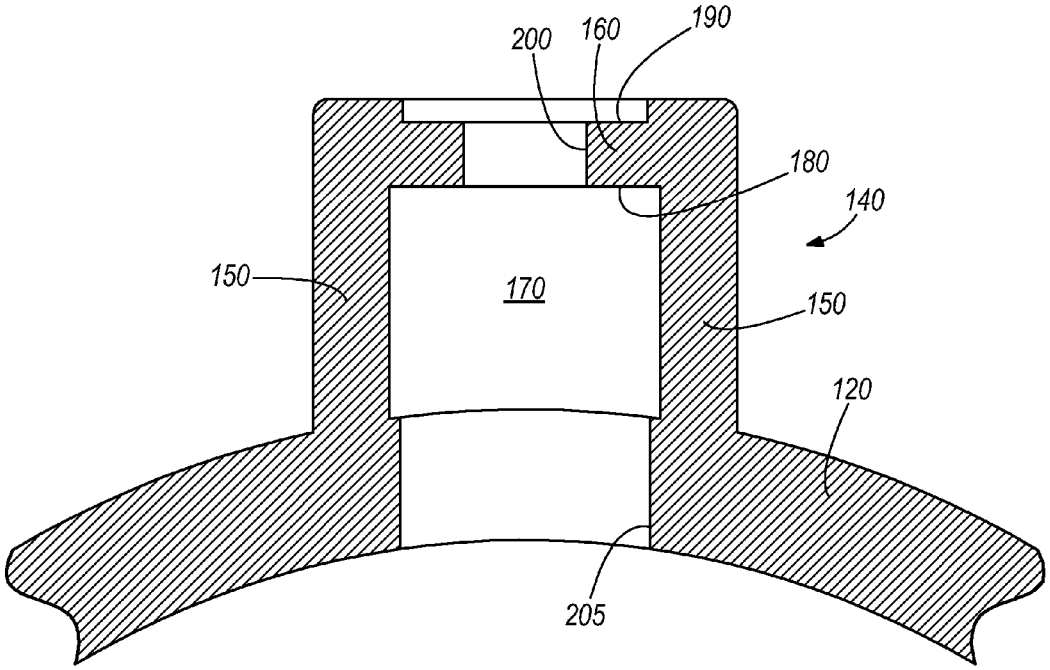
FIG. 3 is a cross-sectional view of a portion of the handle in which the safety mechanism received.

Referring now to FIG. 3, the hub 120 includes a boss 140 that has side walls 150 and an end wall 160. In a circular boss 140, such as that illustrated, the side walls 150 are actually a single, continuous side wall 150. The side walls 150 and end wall 160 define therebetween a cavity 170. The end wall 160 includes an inner surface 180 facing into the cavity 170 and an outer surface 190 facing away from the cavity 170. The end wall 160 also defines a clearance opening 200 that communicates with the cavity 170. The clearance opening 200 aligns with a hole 205 in the hub 120, and with the aperture 90 in the pivoting member 80 when the door handle assembly 60 is in an at-rest position (illustrated in FIG. 2).

The safety mechanism 130 is manually movable relative to the hub 120 between the inner position (FIG. 6), an outer position (FIG. 5), and an intermediate position (FIG. 2) between the inner and outer positions.

Figure 4:
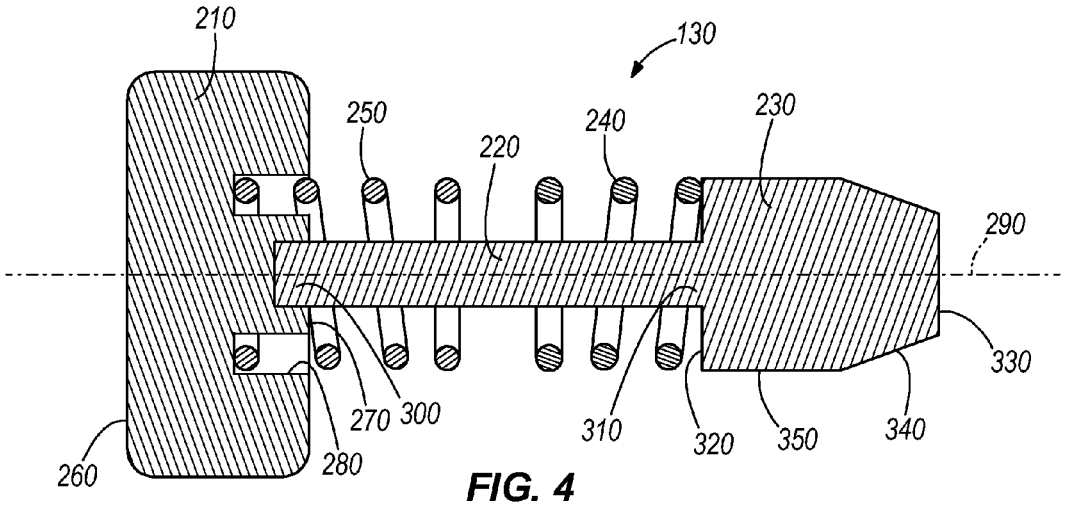
FIG. 4 is a cross-sectional view of the safety mechanism.

With reference to FIG. 4, the safety mechanism 130 includes a button 210, a stem 220, a cam member 230, a first spring 240, and a second spring 250. The button 210 includes a flat engagement surface 260 on one side, a connection point 270 on an opposite side, and a spring seat 280 surrounding the connection point 270. The stem 220 defines a stem axis 290 and includes a first end 300 that connects to the button connection point 270 and a second end 310 that connects to the cam member 230. The stem axis 290 is perpendicular to the pivot axis 100 of the pivoting member 80. In the illustrated embodiment, the stem axis 290 intersects the pivot axis 100.

The cam member 230 defines at one end a shoulder 320 that surrounds the second end 310 of the stem 220, and a blunt tip 330 at the end opposite the shoulder 320. The cam member 230 defines a detent surface 340 adjacent the tip 330, and a driving surface 350 between the detent surface 340 and the shoulder 320. The detent surface 340 (which may alternatively be termed a "detent surface") is angled greater than 0° and less than 90° with respect to the stem axis 290. A lateral force (i.e., perpendicular to the stem axis 290) applied to the detent surface 340 will result in a component of force acting on the safety mechanism 130 parallel to the stem axis 290. The driving surface 350 is parallel to the stem axis 290, so a lateral force applied to the driving surface 350 will include no component that is parallel to the stem axis 290.

The first spring 240 and the second spring 250 are compression springs having approximately equal lengths and spring coefficients in the illustrated embodiment, although springs of mixed sizes, types, and stiffness can be employed in other embodiments. The first spring 240 exerts a first biasing force on the cam member 230 toward the inner position, and the second spring 250 exerts a second biasing force on the button 210 toward the outer position. The first biasing force may be said to be directed "radially inward" because it is directed parallel to the stem axis 290 toward the pivot axis 100, and the second biasing force may be said to be directed "radially outward" because it is directed parallel to the stem axis 290 away from the pivot axis 100. In the absence of other external forces, the first and second biasing forces equal each other when the cam member 230 is in the intermediate position, such that the first and second springs 240, 250 can be said to cooperate to bias the cam member 230 into the intermediate position.

The safety mechanism 130 is mounted to the boss 140. More specifically, the first spring 240 is placed around the stem 220, and the first end 300 of the stem 220 is extended through the clearance hole 200, such that the first spring 240 and the cam member 230 are positioned within the cavity 170. The second spring 250 is positioned around the first end 300 of the stem 220 outside of the cavity 170. The first end 300 of the stem 220 is secured to the button 210 at the connection point 270 with a suitable connection arrangement, such as glue, friction welding, swaging, press fitting, or a threaded engagement, or the button 210, stem 220, and cam 230 (or any two of those components) can be die cast as a single component. As can be seen in the drawings, the ends of the second spring 250 engage the spring seat 280 of the button 210 and the outer surface 190 of the end wall 160 of the boss 140, and the ends of the first spring 240 engage the inner surface 180 of the end wall 160 of the boss 140 and the shoulder 320 of the cam member 230.

In the intermediate position, the detent surface 340 of the cam member 230 is within the aperture 90 in the pivoting member 80. In the outer position, the tip 330 of the cam member 230 abuts the outer surface of the pivoting member 80. The outer position may also be termed the "disengaged position" or "uncoupled position." In the inner position, the driving surface 350 of the cam member 230 abuts the pivoting member 80 within the aperture 90. The inner position may also be termed the "engaged position" or "coupled position."

With reference to FIG. 2, the engagement of the detent surface 340 within the aperture 90 resists rotation of the handle 110 and hub 120 with respect to the pivoting member 80. In the illustrated embodiment, the handle 110 is a lever, which is supported in cantilever fashion by the pivoting member. It is often desirable, for aesthetic and functional reasons, to hold the lever 110 in a horizontally-extending position (as in FIGS. 1 and 2) when in the intermediate position. Gravity acting on the lever 110 creates a clockwise (as viewed in FIG. 2, although it could be counterclockwise in other configurations) torque on the handle 110 (which will be referred to herein as "at-rest torque") about the pivot axis 100.

The arrangement of the detent surface 340 and the first spring 240 preferably provides sufficient detent holding force such that the at-rest torque, acting alone, does not deflect the first spring 240 to an extent sufficient to remove the cam member 230 from the aperture 90. The safety mechanism 130 can therefore be referred to as a detent mechanism for holding the handle 110 in the intermediate position until a person applies additional torque (i.e., in addition to the at-rest torque) to the handle 110.

Figure 5:
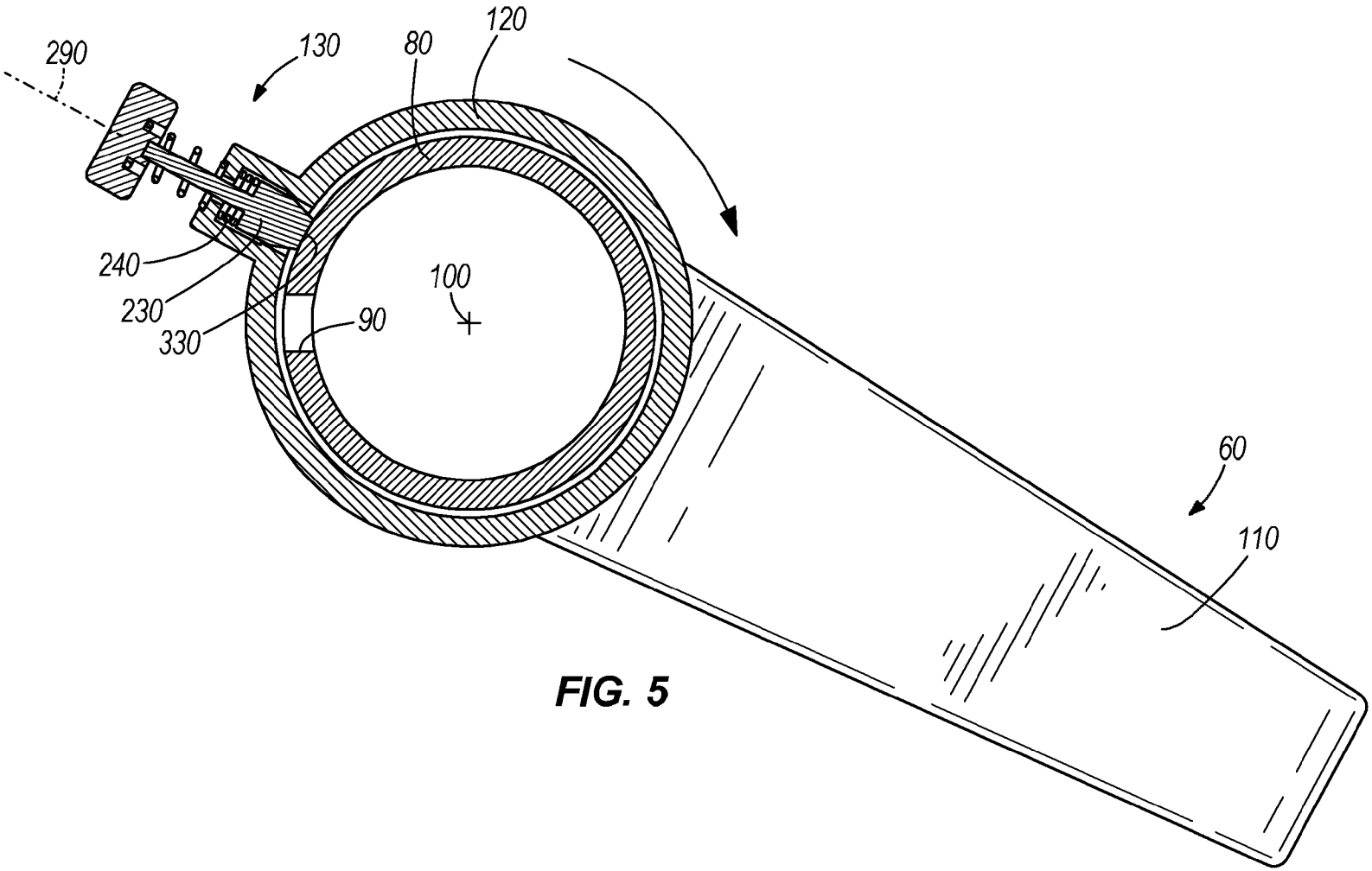
FIG. 5 is a cross-sectional view of the safety mechanism in an outer position and the handle rotated.

With reference to FIG. 5, in the event the handle 110 and hub 120 are turned while the safety mechanism 130 is in the intermediate position, a lateral force is applied by the edge of the aperture 90 against the detent surface 340 of the cam member 230. As noted above, the lateral force gives rise to a radially outward force component applied to the safety mechanism 130. If the radially outward component of force is sufficient to overcome the first biasing force, it causes the cam member 230 to ride out of the aperture 90 in the pivoting member 80, into the outer position.

As the cam member 230 moves radially outward, the first spring 240 is compressed between the inner surface 180 of the end wall 160 and the shoulder 320 of the cam member 230, and the second spring 250 is relaxed as the button 210 moves radially outward away from the end wall 160. The first biasing force increases as the first spring 240 is compressed, and the second biasing force decreases as the second spring 250 relaxes. With the cam member 230 removed from the aperture 90, the hub 120 is uncoupled from the pivoting member 80 and the handle 110 and hub 120 are free to rotate with respect to the pivoting member 80. Consequently, no torque is transmitted from the handle 110 and hub 120 to the pivoting member 80 and the pivoting member 80 is not rotated. The safety mechanism 130 returns to the intermediate position under the influence of the first biasing force when the handle 110 and hub 120 are rotated back to the neutral position and the cam member 230 is aligned with the aperture 90.

Figure 6:
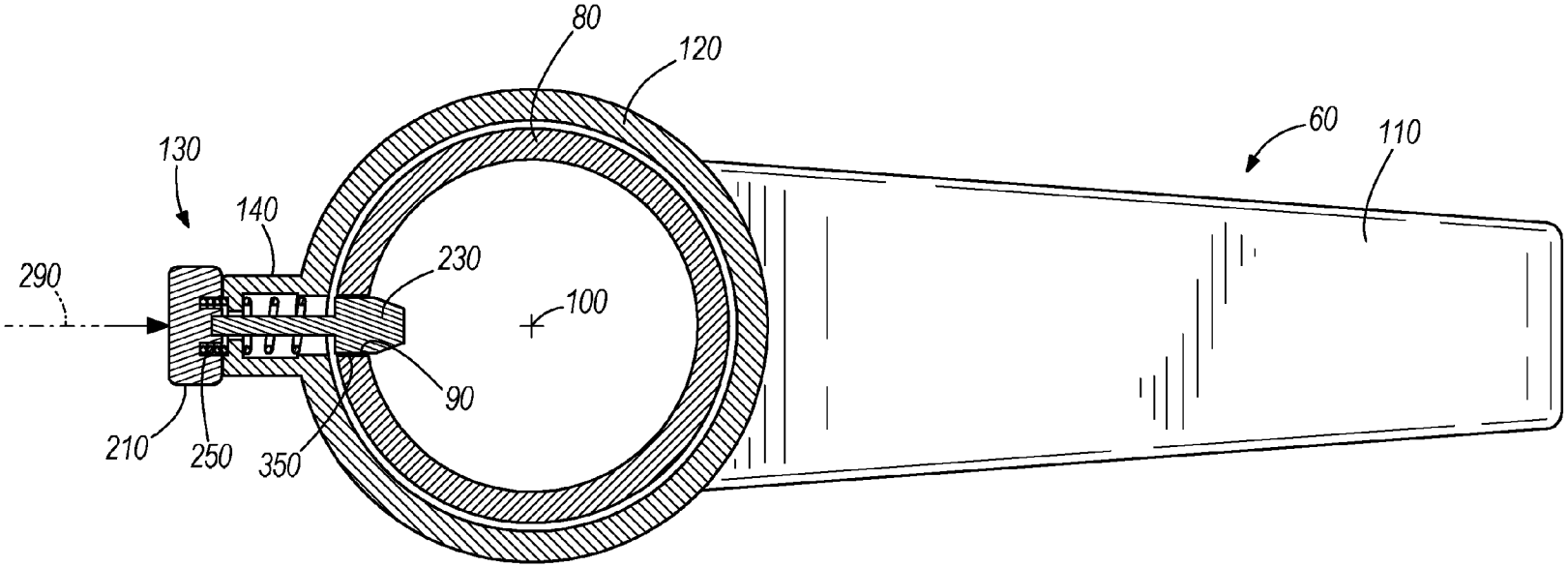
FIG. 6 is a cross-sectional view of the safety mechanism in an inner position.

With reference to FIG. 6, when the safety mechanism 130 is actuated into the inner position, the cam member 230 is moved axially into the aperture 90 in the pivoting member 80 such that the driving surface 350 of the cam member 230 is within the aperture 90. The safety mechanism 130 may be actuated from the intermediate position into the inner position by a person applying a radially inward deflecting force on the button 210 (e.g., with the person's thumb or finger).

As the safety mechanism 130 moves toward the inner position, the second spring 250 is compressed between the button 210 and the outer surface 190 of the end wall 160, and the first spring 240 is relaxed as the cam member 230 moves axially inward away from the end wall 160. The second biasing force increases as the second spring 250 is compressed, and the first biasing force decreases as the first spring 240 relaxes. With the driving surface 350 moved into the aperture 90, the hub 120 is coupled for rotation with the pivoting member 80 and the handle 110, and torque is transmitted from the handle 110 and hub 120 to the pivoting member 80. Pivoting of the pivoting member 80 causes the latching member 70 to be retracted from the receptacle in the door jamb to permit the door 10 to be opened. The safety mechanism 130 returns to the intermediate position under the influence of the second biasing force when the deflecting force is removed from the button 210.

Figure 7:
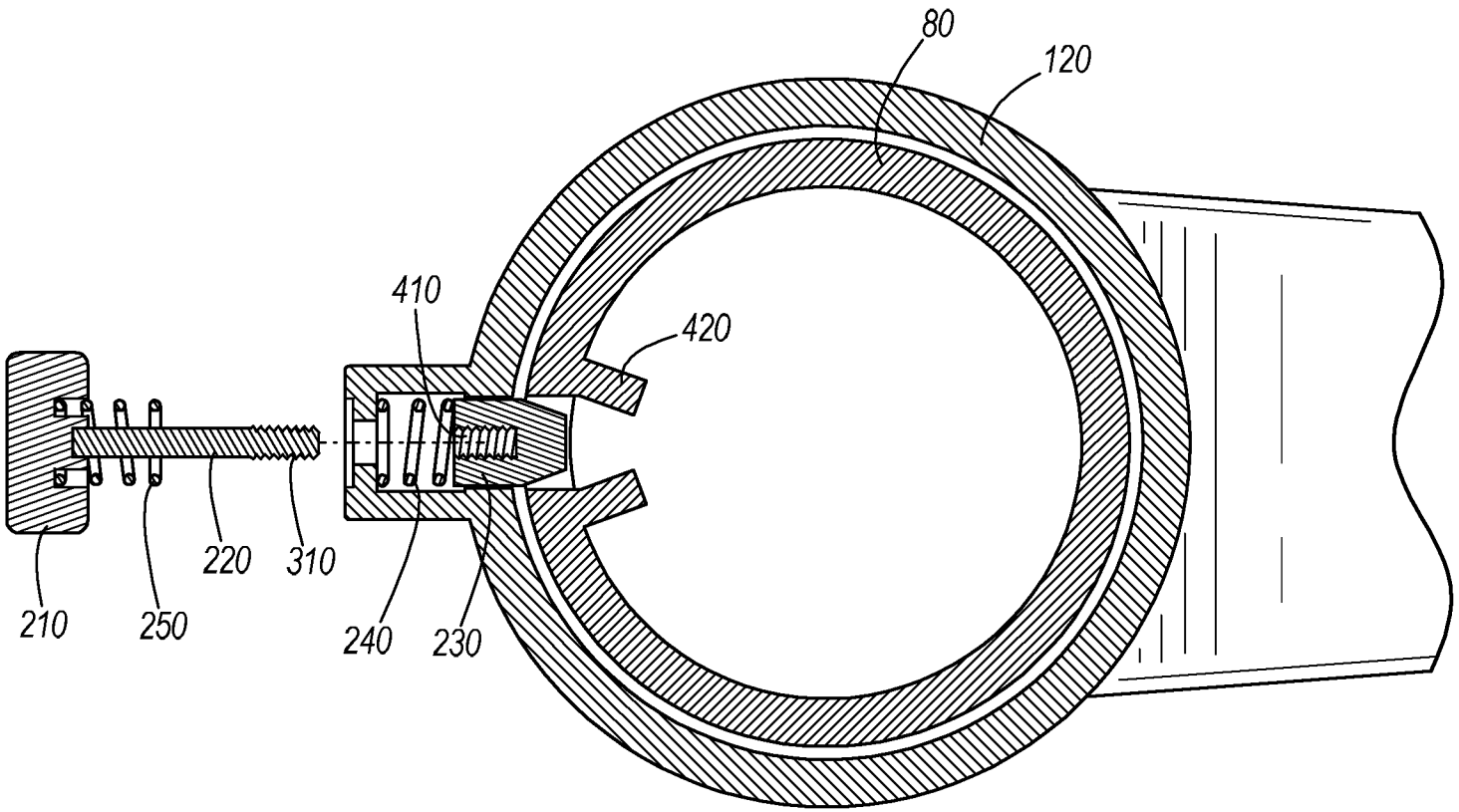
FIG. 7 is an exploded, cross-sectional view of an alternative assembly for the safety mechanism.

FIG. 7 illustrates a variation on the safety mechanism 130, in which the second end 310 of the stem 220 is threaded, and the cam member 230 includes a threaded hole 410 for receiving the second end 310 by a threaded connection. The pivoting member 80 in this embodiment includes retaining walls 420, or a single retaining wall 420 if it is circular or tubular. The retaining walls 420 are angled to match the shape of the driving surface 350 and the detent surface 340 of the cam member 230. The retaining walls 420 define a gap into which the blunt tip 330 of the cam member 230 fits. The retaining walls 420 are deep enough to receive substantially the entire cam member 230, such that the shoulder surface 320 of the cam member 230 does not contact the hub 120 during assembly.

The door handle assembly 60 is installed onto the pivoting member 80 by first inserting the cam member 230 through the aperture 90, into the space within the retaining walls 420. The first spring 240 is placed in the cavity 170. Then the hub 120 is slid over the pivoting member 80 so that the cam member 230 is aligned with the cavity 170. The stem 220 and button 210 are provided as a single, integral component or a pre-assembled component. The second spring 250 is positioned around the stem 220 and in the spring seat 280. The second end 310 of the stem 220 is inserted into the cavity 170 via the clearance hole 200. With the stem 220 pushing the cam member 230 against the retaining walls 420, the second end 310 is threaded into the threaded hole 410 in the cam member 230. The retaining walls 420 provide a bearing surface against which the cam member 230 is pressed, and the shape of the retaining walls 420 maximizes surface area contact and frictional engagement with the cam member 230 to facilitate a tight threaded engagement. As the cam member 230 is pressed against the retaining walls 420, the tip 330 is within the gap and therefore not exposed to forces or impact that would mar it as the stem 220 is threaded into the cam member 230. The tip 330 should be maintained reasonably smooth so that the tip 330 can slide over the outer surface of the pivoting member 80 without imparting significant torque to the pivoting member 80 when the hub 120 is uncoupled from the pivoting member 80.

Figure 8:
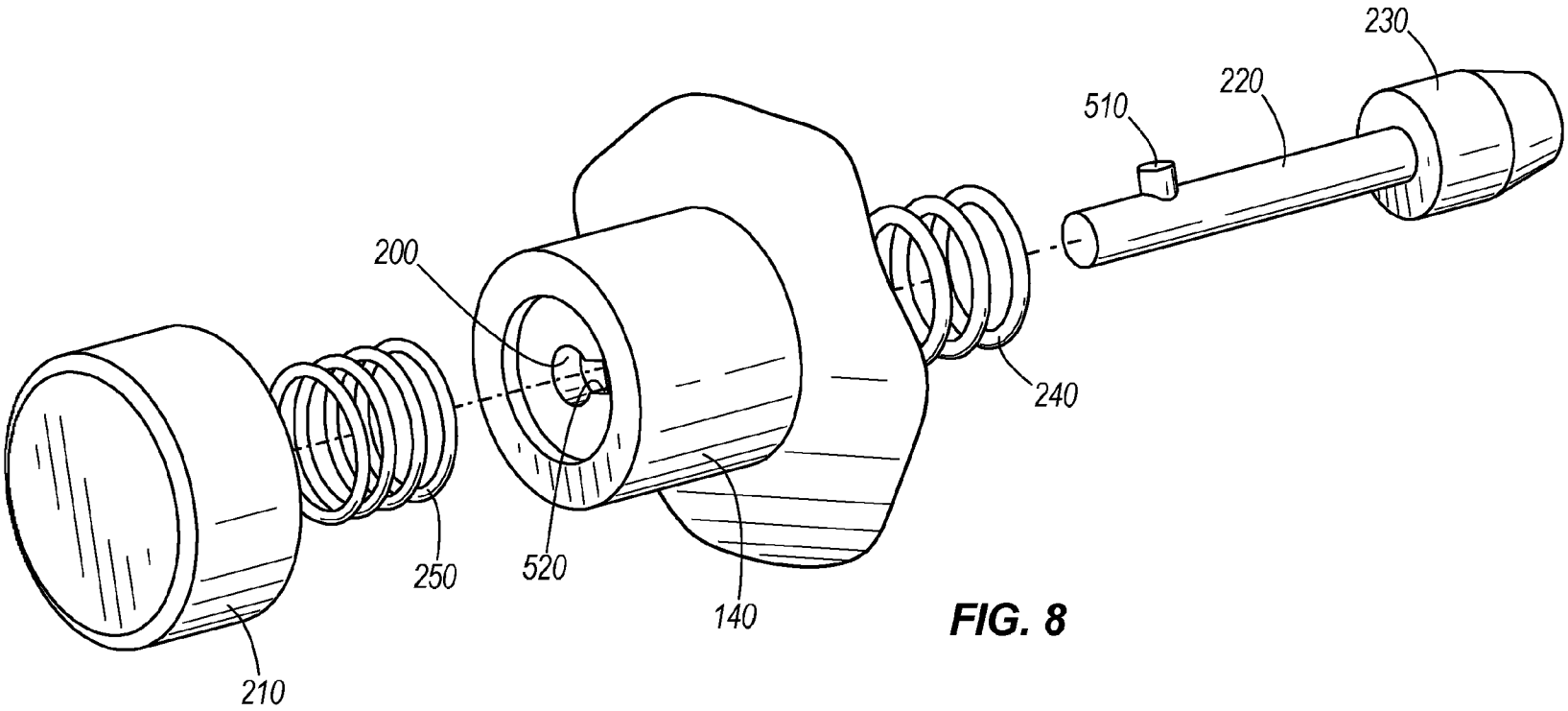
FIG. 8 is an exploded, perspective view of another alternative assembly for the safety mechanism.
Figure 9:
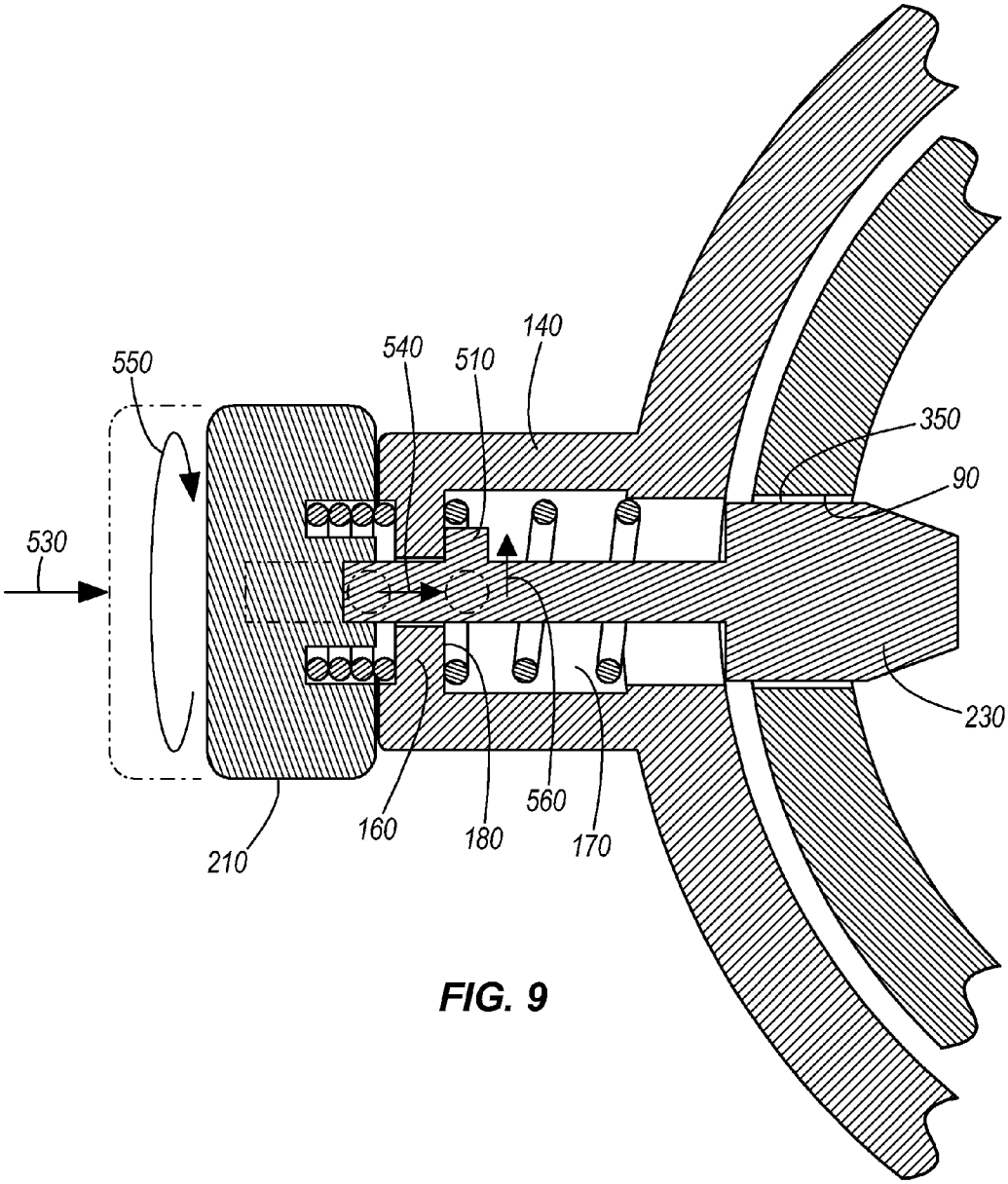
FIG. 9 is a cross-sectional view of the safety mechanism of FIG. 8 installed on the door handle.

FIGS. 8 and 9, illustrate another arrangement of the present invention, which features a twist-lock mechanism for holding the safety mechanism 130 in the inner position. In this arrangement, the stem 220 includes a stub 510 extending perpendicular to the stem axis 290 and the boss 140 includes a slot or channel 520. The slot 520 extends parallel to the stem axis 290 along a side of the clearance hole 200.

As illustrated in FIG. 9, the stem 220 is inserted in the clearance opening 200, with the stub 510 received in the slot 520. A deflecting force 530 moves the safety mechanism 130 axially, and the stub 510 moves axially as illustrated with arrow 540. When the stub 510 has cleared the end wall 160 (i.e., is within the cavity 170), the button 210 can be twisted, as illustrated with arrow 550, to move the stub 510 out of alignment with the slot 520, as illustrated with arrow 560. When the button 210 is released, the second spring 250 biases the button 210 and stem 220 axially outward, but the stub 510 abuts against the inner surface 180 of the end wall 160 to prevent the axial movement. As a result, the cam member 230 is locked in the engaged position, with the driving surface 350 in the aperture 90. As a result, the pivoting member 80 and hub 120 are coupled until the button 210 is rotated to align the stub 510 with the slot 520, at which time the second biasing force will move the safety mechanism 130 axially outward into the disengaged position.

The invention is not limited to the illustrated embodiment, and can be applied to other apparatus in which it is desirable to disengage a handle from performing its function unless a safety mechanism is actuated. A non-exclusive list of examples of such apparatus includes: knobs, hot water faucets, and oven or stove dials. In such alternative apparatus, the handle and hub described above may be more generically referred to as an actuating member that is manually pivotable about the axis of the pivoting member.

For example, the invention could be more broadly described as a mechanism for selectively coupling a first moving part with a second moving part. The moving parts do not necessarily need to be pivoting members. When coupled, the first and second moving parts move together, and when uncoupled, the first moving part moves with respect to the second moving part. The second moving part includes an aperture (e.g., including an aperture similar to aperture 90). The mechanism includes an engaging member (e.g., including members such as the cam member 230), a biasing member (e.g., including arrangements such as the first and second springs 240, 250), and an actuating member (e.g., including a members similar to the button 210).

The engaging member is carried by the first part, and has a detent surface and a load transferring surface (e.g., which may be similar to the detent surface 340 and driving surface 350 or another arrangement). The engaging member is movable between a detent position in which the detent surface is within the aperture of the second moving part, a uncoupled position in which the engaging member is fully retracted from the aperture, and a coupled position in which the load transferring surface is within the aperture.

The biasing member acts with a biasing force on the engaging member to bias the engaging member into the detent position. Alternatively, the biasing force may bias the engagement member into the coupled position.

The actuating member may be manually manipulated to actuate the engaging member to overcome the biasing force of the biasing member and move the engaging member into the coupled position (or detent position, as the case may be) such that the first and second moving parts are coupled for movement together (or held with a detent force, as the case may be). With the engaging member in the detent position, relative movement of the first moving part and second moving part results in a component of force acting against the biasing force, such that the biasing force is overcome and the engaging member rides out of the aperture in the second moving member, into the uncoupled position.

As noted in the illustrated embodiment, the first moving part may comprise a handle and the second moving part may comprises a spindle on which the handle is supported, with the handle and spindle rotating about a concentric axis of rotation. The handle may take the form of a lever, as illustrated and described above. The lever may be maintained in a horizontal condition when the engaging member is in the detent position. The biasing force should be sufficient to maintain the engaging member in the detent position under at-rest torque applied to the lever under the influence of gravity.

The engaging member may include a cam member that defines the detent surface and load transferring surface, and a stem having a first free end extending through a portion of the first moving part and an opposite second end that is attached to the cam member. The stem may define a stem axis, and movement of the engaging member between the detent, coupled, and uncoupled positions is in a direction parallel to the stem axis. Movement of the engaging member from the detent position to the uncoupled position may be in an opposite direction from movement of the engaging member from the detent position to the coupled position.

If the first moving part and second moving part are rotatable about a common pivot axis, the stem axis may be perpendicular to the pivot axis. In such an arrangement, movement of the engaging member from the detent position to the uncoupled position could be radially away from the pivot axis, and movement of the engaging member from the detent position to the coupled position could be radially toward the pivot axis. In other embodiments, the movement could be reversed (moving radially toward the pivot axis into the uncoupled position and radially away from the pivot axis into the coupled position).

The biasing member might include first and second springs applying respective opposing first and second biasing forces on the engaging member, as described and illustrated above. The biasing member could have other arrangements, in which the first and second opposing biasing forces result in the biasing force that biases the engaging member toward the detent position. Movement of the engaging member toward the coupled position may deflect the first spring to increase the first biasing force and relaxes the second spring to decrease the second biasing force, and movement of the engaging member toward the uncoupled position may deflect the second spring to increase the second biasing force and relaxes the first spring to decrease the first biasing force.

In embodiments in which the engaging member is biased into the detent position, there may be provided a locking mechanism (e.g., similar to the twist-lock mechanism) that can be employed to keep the engaging member in the coupled position and resist movement of the engaging member back to the detent position. In embodiments in which the engaging member is biased into the coupled position, the locking mechanism may be used to hold the engaging member in the detent position (such that it will ride out into the uncoupled position upon relative movement between the first and second moving parts) and resist movement of the engaging member back into the coupled position.

Thus, the invention provides, among other things, a safety mechanism for coupling an actuator to a pivoting member when the safety mechanism is manually actuated, and for uncoupling the actuator and pivoting member when the safety mechanism is not manually actuated. Various features and advantages of the invention are set forth in the following claims.

What is claimed is:

1. A door latching apparatus comprising a latching mechanism configured to be mounted on a door, the latching mechanism including a latching member having extended and retracted positions relative to the door for releasably securing the door relative to an adjacent structure, and the latching mechanism including a pivoting member operably connected to the latching member such that pivotal movement of the pivoting member about an axis moves the latching member between the extended and retracted positions, the pivoting member having therein an aperture defined by a wall, a handle manually pivotable about the axis, the handle including a hub surrounding a portion of the pivoting member, the hub having therein an opening, and a safety mechanism including a manually movable cam member having a detent surface and a driving surface, the cam member movable relative to the hub between an inner position, an outer position and an intermediate position between the inner and outer positions, and the mechanism also including a first spring exerting on the cam member a force biasing the cam member in the direction from the intermediate position to the inner position, and a second spring exerting on the cam member a force biasing the cam member in the direction from the inner position to the intermediate position, the first and second springs having spring forces such that the cam member is in the intermediate position absent external forces, wherein, when the cam member is in the intermediate position, the cam member extends partially into the aperture such that if the handle is pivoted relative to the pivoting member, engagement between the detent surface and the wall causes the cam member to move against the force of the spring to the outer position, wherein, when the cam member is in the outer position, the cam member is withdrawn from the aperture such that pivotal movement of the handle does not cause pivotal movement of the pivoting member, and wherein, when the cam member is in the inner position, the cam member extends fully into the aperture such that if the handle is pivoted relative to the pivoting member, the driving surface of the cam member engages the wall and pivotal movement of the handle causes pivotal movement of the pivoting member.

2. Apparatus comprising a pivoting member pivotable about an axis and configured to be operably connected to a device to be operated, the pivoting member having therein an aperture defined by a wall, an actuating member manually pivotable about the axis, the actuating member including a hub surrounding a portion of the pivoting member, the hub having therein an opening, and a safety mechanism including a manually movable cam member having a detent surface and a driving surface, the cam member movable relative to the hub between an inner position, an outer position and an intermediate position between the inner and outer positions, and the mechanism also including a first spring exerting on the cam member a force biasing the cam member in the direction from the intermediate position to the inner position, and a second spring exerting on the cam member a force biasing the cam member in the direction from the inner position to the intermediate position, the first and second springs having spring forces such that the cam member is in the intermediate position absent external forces, wherein, when the cam member is in the intermediate position, the cam member extends partially into the aperture such that if the actuating member is pivoted relative to the pivoting member, engagement between the detent surface and the wall causes the cam member to move against the force of the spring to the outer position, wherein, when the cam member is in the outer position, the cam member is withdrawn from the aperture such that pivotal movement of the actuating member does not cause pivotal movement of the pivoting member, and wherein, when the cam member is in the inner position, the cam member extends fully into the aperture such that if the actuating member is pivoted relative to the pivoting member, the driving surface of the cam member engages the wall and pivotal movement of the actuating member causes pivotal movement of the pivoting member.

3. A mechanism for selectively coupling a first moving part with a second moving part such that the first and second moving parts move together, the second moving part having an aperture, the mechanism comprising:

an engaging member carried by the first part, the engaging member having a detent surface and a load transferring surface, the engaging member being movable between a detent position in which the detent surface is within the aperture of the second moving part, a uncoupled position in which the engaging member is fully retracted from the aperture, and a coupled position in which the load transferring surface is within the aperture;

a biasing member acting with a biasing force on the engaging member to bias the engaging member into the detent position; and an actuating member for manually actuating the engaging member to overcome the biasing force of the biasing member and move the engaging member into the coupled position such that the first and second moving parts are coupled for movement together;

wherein relative movement of the first moving part and second moving part with the engaging member in the detent position results in a component of force acting against the biasing force, such that the biasing force is overcome and the engaging member rides out of the aperture in the second moving member, into the uncoupled position.

4. The mechanism of claim 3, wherein the first moving part comprises a handle and the second moving part comprises a spindle on which the handle is supported, the handle and spindle rotating about a concentric axis of rotation.

5. The mechanism of claim 4, wherein the handle includes a lever; wherein the lever is in a horizontal condition when the engaging member is in the detent position; and wherein the biasing force is sufficient to maintain the engaging member in the detent position under at-rest torque applied to the lever under the influence of gravity.

6. The mechanism of claim 3, wherein the engaging member includes a cam member that defines the detent surface and load transferring surface, and a stem having a first free end extending through a portion of the first moving part and an opposite second end that is attached to the cam member; wherein the stem defines a stem axis; and wherein movement of the engaging member between the detent, coupled, and uncoupled positions is in a direction parallel to the stem axis.

7. The mechanism of claim 6, wherein movement of the engaging member from the detent position to the uncoupled position is in an opposite direction from movement of the engaging member from the detent position to the coupled position.

8. The mechanism of claim 7, wherein the first moving part and second moving part are rotatable about a common pivot axis; wherein the stem axis is perpendicular to the pivot axis; wherein movement of the engaging member from the detent position to the uncoupled position is radially away from the pivot axis; and wherein movement of the engaging member from the detent position to the coupled position is radially toward the pivot axis.

9. The mechanism of claim 6, wherein the engaging member includes a button mounted to the first end of the stem.

10. The mechanism of claim 3, wherein the engaging member moves in a first direction from the detent position to the uncoupled position and in a second direction, opposite the first direction, from the detent position to the coupled position; and wherein the biasing member includes first and second springs applying respective opposing first and second biasing forces on the engaging member, a combination of the first and second opposing biasing forces resulting in the biasing force that biases the engaging member toward the detent position; wherein movement of the engaging member toward the coupled position deflects the first spring to increase the first biasing force and relaxes the second spring to decrease the second biasing force; and wherein movement of the engaging member toward the uncoupled position deflects the second spring to increase the second biasing force and relaxes the first spring to decrease the first biasing force.

11. The mechanism of claim 3, further comprising a locking mechanism with which the engaging member can be manually moved into the coupled position against the biasing force, and locked into the coupled position.

12. A mechanism for selectively coupling a first moving part with a second moving part such that the first and second moving parts move together, the second moving part having an aperture, the mechanism comprising:

an engaging member carried by the first part, the engaging member having a detent surface and a load transferring surface, the engaging member being movable between a detent position in which the detent surface is within the aperture of the second moving part, a uncoupled position in which the engaging member is fully retracted from the aperture, and a coupled position in which the load transferring surface is within the aperture;

a biasing member acting with a biasing force on the engaging member to bias the engaging member into the coupled position; and an actuating member for manually actuating the engaging member to overcome the biasing force of the biasing member and move the engaging member into the detent position such that the first and second moving parts are coupled for movement together;

wherein relative movement of the first moving part and second moving part with the engaging member in the detent position results in a component of force acting against the biasing force, such that the biasing force is overcome and the engaging member rides out of the aperture in the second moving member, into the uncoupled position.

13. The mechanism of claim 12, further comprising a locking mechanism with which the engaging member can be manually moved into the detent position against the biasing force, and locked into the detent position against movement into the coupled position.

* * * * *